US006592712B2

(12) United States Patent
Koukoulas et al.

(10) Patent No.: US 6,592,712 B2
(45) Date of Patent: Jul. 15, 2003

(54) METHOD TO MANUFACTURE PAPER USING FIBER FILLER COMPLEXES

(75) Inventors: Alexander A. Koukoulas, Ridgewood, NJ (US); Thomas E. Altman, Middletown, NY (US); M. C. Matthew, Neshanic Station, NJ (US); Thomas E. Amidon, Jamesville, NY (US); Fernand Mora, Pont de Claix (FR)

(73) Assignee: International Paper Company, Stamford, CT (US)

( * ) Notice: Subject to any disclaimer, the term of this patent is extended or adjusted under 35 U.S.C. 154(b) by 0 days.

(21) Appl. No.: 09/891,016

(22) Filed: Jun. 25, 2001

(65) Prior Publication Data

US 2002/0096272 A1 Jul. 25, 2002

Related U.S. Application Data

(60) Provisional application No. 60/214,593, filed on Jun. 27, 2000.

(51) Int. Cl.[7] ..... D21H 17/70

(52) U.S. Cl. ..... 162/9; 162/100; 162/149; 162/181.1; 162/181.2; 162/182; 162/189; 162/190

(58) Field of Search ..... 162/9, 100, 181.1, 162/181.2, 182, 190, 189, 149

(56) References Cited

U.S. PATENT DOCUMENTS

| | | | | |
|---|---|---|---|---|
| 2,470,577 A | | 5/1949 | Roderick et al. | |
| 3,152,001 A | | 10/1964 | Podschus et al. | |
| 3,262,877 A | | 7/1966 | Le Compte, Jr. | |
| 3,639,206 A | | 2/1972 | Spruill | |
| 3,833,463 A | | 9/1974 | Croom | |
| 3,833,464 A | | 9/1974 | Rolfe | |
| 4,941,945 A | | 7/1990 | Pettersson | |
| 5,082,887 A | | 1/1992 | Brown et al. | |
| 5,223,090 A | * | 6/1993 | Klungness et al. | 162/183 |
| 5,262,006 A | | 11/1993 | Andersson et al. | |
| 5,275,699 A | | 1/1994 | Allan et al. | |
| 5,342,600 A | | 8/1994 | Bleakley et al. | |
| 5,558,782 A | | 9/1996 | Bleakley et al. | |
| 5,665,205 A | | 9/1997 | Srivatsa et al. | |

(List continued on next page.)

FOREIGN PATENT DOCUMENTS

| | | |
|---|---|---|
| EP | 0604095 A1 | 6/1994 |
| EP | 0658606 A1 | 6/1995 |
| EP | 0936185 A1 | 8/1999 |
| EP | 1052227 A2 | 11/2000 |
| GB | 2265916 A | 10/1993 |
| JP | 162098/1987 | 7/1987 |
| WO | WO 96/28517 | 9/1996 |
| WO | WO 99/03928 | 1/1999 |
| WO | WO 99/42657 | 8/1999 |
| WO | WO 00/39029 | 7/2000 |

OTHER PUBLICATIONS

Toivonen, Olavi "A New Waste Conversion and Recycling Process" 82nd Annual Meeting, Technical Setion, CPPA, pp. A101–107, 1996.

Martin, RSE and Dr. RD Crowling "The Re–Use of Mineral and Fines From Paper Mill Waste Streams", 1998, pp. 227–237.

*Primary Examiner*—Peter Chin
(74) *Attorney, Agent, or Firm*—Dara L. Onofrio, Esq.; Onofrio Law

(57) ABSTRACT

A method for manufacture of loaded paper or paperboard products, comprising the steps of separating at least one process stream from the papermaking process, wherein the process stream includes fines and/or filler; combining the process stream with long fibers and thickening to form a residue; treating the residue to form fiber-filler complexes; and using the fiber-filler complexes in the papermaking process to form the paper.

22 Claims, 8 Drawing Sheets

U.S. PATENT DOCUMENTS 5,679,220 A 10/1997 Matthew et al.
5,731,080 A 3/1998 Cousin et al.
5,733,461 A * 3/1998 Bleakley et al. ..... 162/190
5,824,364 A 10/1998 Cousin et al.
5,830,364 A 11/1998 Bleakley
5,833,747 A 11/1998 Bleakley et al.
5,977,003 A 11/1999 Wilshaw et al.
6,003,795 A 12/1999 Brown et al.
6,004,467 A 12/1999 Bleakley
6,030,704 A 2/2000 Wilshaw et al.
6,251,222 B1 * 6/2001 Silenius et al. ..... 162/9

* cited by examiner

METHOD TO MANUFACTURE PAPER USING FIBER FILLER COMPLEXES

This application claims the benefit of U.S. provisional application No. 60/214,593 filed Jun. 27, 2000, which is incorporated herein by reference.

FIELD OF THE INVENTION

The present invention relates to a process for loading particulate filler complexes, and more particularly, increasing the deposition and retention of these filler complexes on fibers for manufacture of paper or paperboard products.

BACKGROUND OF THE INVENTION

Inorganic material such as precipitated calcium carbonate (PCC) ground calcium carbonate (GCC), clay and talc are used extensively as fillers in the paper making process. Filler loading levels of 12–25% are typical in current paper making strategy to improve optical properties of the paper such as brightness and opacity. In some instances, the economics of substituting expensive fiber with inexpensive filler lends added incentive.

To insure that the fillers remain with the fiber web and ultimately with the paper product, retention aids are used. Normally retention aids are long chained polymeric compounds that flocculate the furnish and enhance filler-fiber "attachment." However, high flocculation levels lead to non-uniformity in the web and poor paper formation.

To circumvent this, a method to attach the filler directly on to the fiber surfaces was described in French Patent 92-04474 and U.S. Pat. Nos. 5,731,080 & 5,824,364 to Cousin et al. In these patents a slip stream of pulp furnish is refined to low freeness (<70 Canadian standard freeness [csf] vs. 450 csf, typically) and then treated to generate a highly loaded filler-fiber complex. When these complexes are recombined with untreated pulp, any desirable filler level can be targeted.

An alternative approach is described in U.S. Pat. No. 5,679,220 to Matthew et al. and U.S. Pat. No. 5,665,205 to Srivatsa et al. In both Srivatsa and Matthew the entire furnish is treated to nominal filler loadings without subjecting the pulp to high refining levels (low freeness). However, this procedure results in increases in capital and operating costs due to the treatment of larger pulp volumes. Accordingly, there is a need in the art to generate filler-fiber complexes easily and inexpensively as provided by the invention.

It is known in the art to produce fiber-filler complexes by contacting a fiber slurry with slaked lime and carbon dioxide gas to precipitate calcium carbonate (PCC). Such processes are described in the Cousin et al., Srivatsa, and Matthew et al. patents. The Cousin et al. patents describe a process for obtaining a fiber-based composite produced by precipitating calcium carbonate in situ in an aqueous suspension of fibers of expanded surface area having microfibrils on their surface. The crystals of precipitated calcium carbonate (PCC) are organized essentially in clusters of granules directly grafted on to the microfibrils without any binders or retention aids such that the crystals trap the microfibrils by reliable and non-labile bonding. Srivatsa et al. describes in situ precipitation on secondary fiber furnish. Whereas the Cousin et al. patents describe a batch reaction process, Matthew et al. describes a continuous process for forming fiber-filler complexes.

It is believed that the complexing process relies on anionic charges located on the fiber surfaces that act as nucleation sites to anchor the calcium carbonate crystal on to the fiber. The precipitating calcium carbonate physically binds on to the fiber at these sites. Typically, as you refine pulp, more surface area is generated and additional anchoring sites are created on the fiber.

The present invention provides for a source of fiber having a high surface area (anchoring sites) without the need for additional refining by obtaining them from process streams within the paper making process. The invention identifies sources of furnish that are suitable for fiber-filler complexes and provides methods to use them to improve the economics of the process and quality of product. It also targets improvements in paper machine operations, downstream processing of paper mill effluents and paper product characteristics.

Filler and fine recovery from the paper machine white water and other "waste" streams are known in the art. U.S. Pat. Nos. 5,558,782, 5,733,461, 5,830,364 and 6,004,467 to Bleakley et al. disclose treatments of "white water" or waste streams in which an alkaline earth metal carbonate is precipitated to entrain particulate material present in the waste water. Methods to utilize the fines and filler material that escape the paper making process in paper mills are also described in the articles entitled "A New Waste Conversion and Recycling Process" by Olavi Toivonen (82$^{nd}$ Annual Meeting, Technical Section, CPPA pp.A101–107, 1996) and "The re-use of mineral and fines from paper mill waste streams" by RSE Martin and Dr. RD Cowling (1998 pp. 227–237).

PCT Publication WO 99/42657 published on Aug. 26, 1999 describes a process wherein "white water" from a papermaking operation is separated into two components—"laden water" and "clear water"—each of which component is incorporated, respectively, into separate compositions containing calcium bicarbonate and calcium hydroxide. These two compositions are combined to precipitate calcium carbonate on certain fibers.

U.S. Pat. No. 5,262,006 to Anderson discloses a process of making paper from pulp stock containing calcium sulfate wherein calcium carbonate is precipitated in situ by the addition of soluble calcium salt and carbon dioxide. U.S. Pat. No. 3,639,206 to Spruill discloses a method for treating waste water from an alkaline pulping operation by adding thereto calcium oxide or calcium hydroxide followed by carbon dioxide to form a precipitate which presumably entrains therein the fibrous waste materials in the suspension. The latter is removed from the suspension and ultimately disposed of.

EP 0604095 and EP 1052227 concern a processes for the treatment of aqueous suspensions of particular waste material which consists of precipitating an alkaline earth metal carbonate in the aqueous suspension such that the particulate material present in the aqueous suspension to be treated is carried into the alkaline earth metal carbonate precipitate.

EP 658606 discloses a process for the aggregation of waste solids in waste water from a paper manufacturing factory in which the waste water recovery system includes at least one step in which an alkaline earth metal carbonate is precipitated in the aqueous suspension constituting the waste water to form a mixed aggregate material.

WO 99/03928 published on Jan. 20, 1999 describes a process for precipitating crystals of an insoluble white pigment compound in an aqueous medium containing dispersed particles of fine particulate material and fibers to form a composite pigment material comprising a composite fiber matrix, precipitated pigment crystals and fine particulates dispersed and bonded in the matrix.

WO 00/39029 published on Jul. 6, 2000 discloses a process for increasing the solids concentration of a dilute aqueous suspension of a particulate carbonate, especially calcium carbonate, to form a concentrated suspension which is fluid enough to enable it to be pumped and delivered through pipes or hoses but viscous enough to prevent the formation of a sediment of the coarser particles present.

From the prior art mentioned it is seen that processes for filler and fine recovery are known, however, the prior art does not provide a method for combining separated process streams, including fines and/or filler, with long fibers. It would be appreciated that advantage over known applications would be obtained by providing a method for manufacture of loaded paper or paperboard products comprising separating at least one process stream from the papermaking process; wherein said process stream includes fines; combining the process stream with long fibers and thickening to form a residue; and treating the residue to form fiber-filler complexes. These fiber-filler complexes are then used in the papermaking process to form the paper.

Accordingly, it is a broad object of the invention to provide a method to produce fiber-filler complexes and enhance the deposition and retention of these complexes on fibers for the manufacture of paper or paperboard products.

An object of the invention is to provide a source of fiber having high surface area without the need for refining.

A more specific object of the invention is to separate process streams from various points within the paper making process to obtain primary and/or secondary fines for subsequent treatment to form fiber-filler complexes used in the papermaking process to form paper.

A specific object of the invention is to provide paper which has enhanced stiffness properties, enhance filler retention and uniform z- and cross direction filler profiles.

A more specific object of the invention is to provide target filler levels in the paper that are at least 5% and preferably higher than 20%.

SUMMARY OF THE INVENTION

In general, the invention provides a method for manufacture of loaded paper or paperboard products, comprising the steps of separating at least one process stream from the papermaking process, wherein the process stream includes fines. Combining the process stream with long fibers and thickening to form a residue. Treating the residue to form fiber-filler complexes and using the fiber-filler complexes in the papermaking process to form the paper.

The process streams used in the invention process can be separated from any point along the papermaking process, including points prior to the paper machine, from the paper machine or after the paper machine. The process streams separated may include primary or secondary fines and depending on the stream separated may further include filler particles.

The process stream is combined with long fibers, typically having a length greater than 0.1 mm. The long fibers are from any source and can be natural or synthetic. In alternate embodiments, the long fibers are refined to produce greater fiber surface area.

After the combination of the long fibers with the process stream, the material is thickened to form a wet residue. This residue is preferably treated with calcium and carbonate ions to effect crystallization of calcium carbonate in situ. The crystals of calcium carbonate bond to the fines, long fibers and/or fillers which may be present in the residue. The crystals of calcium carbonate, $CaCO_3$ (PCC), are organized essentially in clusters of granules directly grafted onto the fines, filler and/or fiber present in the residue, without binders or retention aids present at the interface between said crystals of PCC and the fines, filler and/or fiber, so that the majority of said crystals of PCC trap said fines, filler and/or fiber by reliable and non-labile bonding to form the fiber-filler complex.

In an alternate embodiment, the residue formed is treated with particulate filler material to form the fiber-filler complexes. The particulate filler material used may be selected from the group consisting of inorganic pigments, organic pigments, organic latices and hollow spheres. Particularly, the pigments are selected from the group consisting of talc, clay, $TiO_2$, calcium carbonate, silica based pigments and aluminum based pigments.

The resulting paper formed has enhanced stiffness properties, enhanced filler retention and has uniform z- and cross direction filler profiles.

Other objects, features and advantages of the present invention will be apparent when the detailed description of the preferred embodiments of the invention are considered with reference to the drawings, which should be construed in an illustrative and not limiting sense as follows:

DETAILED DESCRIPTION OF THE INVENTION

In accordance with the present invention a method for manufacture of loaded paper or paperboard products is provided comprising separating at least one process stream from the papermaking process; wherein the process stream includes fines; combining said process stream with long fibers and thickening to form a residue; treating the residue to form fiber-filler complexes; and using said fiber-filler complexes in the papermaking process to form the paper.

In a preferred embodiment, the invention provides a method for loading of filler material for manufacture of paper or paperboard products, comprising separating at least one process stream from the papermaking process; wherein the process stream includes fines; combining said process stream with long fibers and thickening to form a residue; treating the residue with calcium and carbonate ions to effect crystallization of calcium carbonate in situ to form fiber-filler complexes; and using said fiber-filler complexes in the papermaking process to form the paper.

The crystals of calcium carbonate, $CaCO_3$ (PCC), formed are organized essentially in clusters of granules directly grafted onto the fines, filler and/or fiber present in the residue, without binders or retention aids present at the interface between the crystals of PCC and the fines, filler and/or fiber, so that the majority of the crystals of PCC trap said fines, filler and/or fiber by reliable and non-liabile bonding to form the fiber-filler complexes.

In general, the invention provides an improved process for increasing the deposition and retention of particulate filler complexes on fibers for the manufacture of paper or paperboard products.

The fiber-filler complexes of the invention may be formed according to the process and parameters as are described in U.S. Pat. Nos. 5,731,080 and 5,824,364 to Cousin et al.; 5,665,205 to Srivatsa et al and 5,679,220 to Matthew et al. which all disclose processes involving in situ attachment of precipitated calcium carbonate (PCC). However, the present invention provides an improvement over these processes which are illustrated in the embodiments shown in FIGS. 1 and 2.

Figure 1:
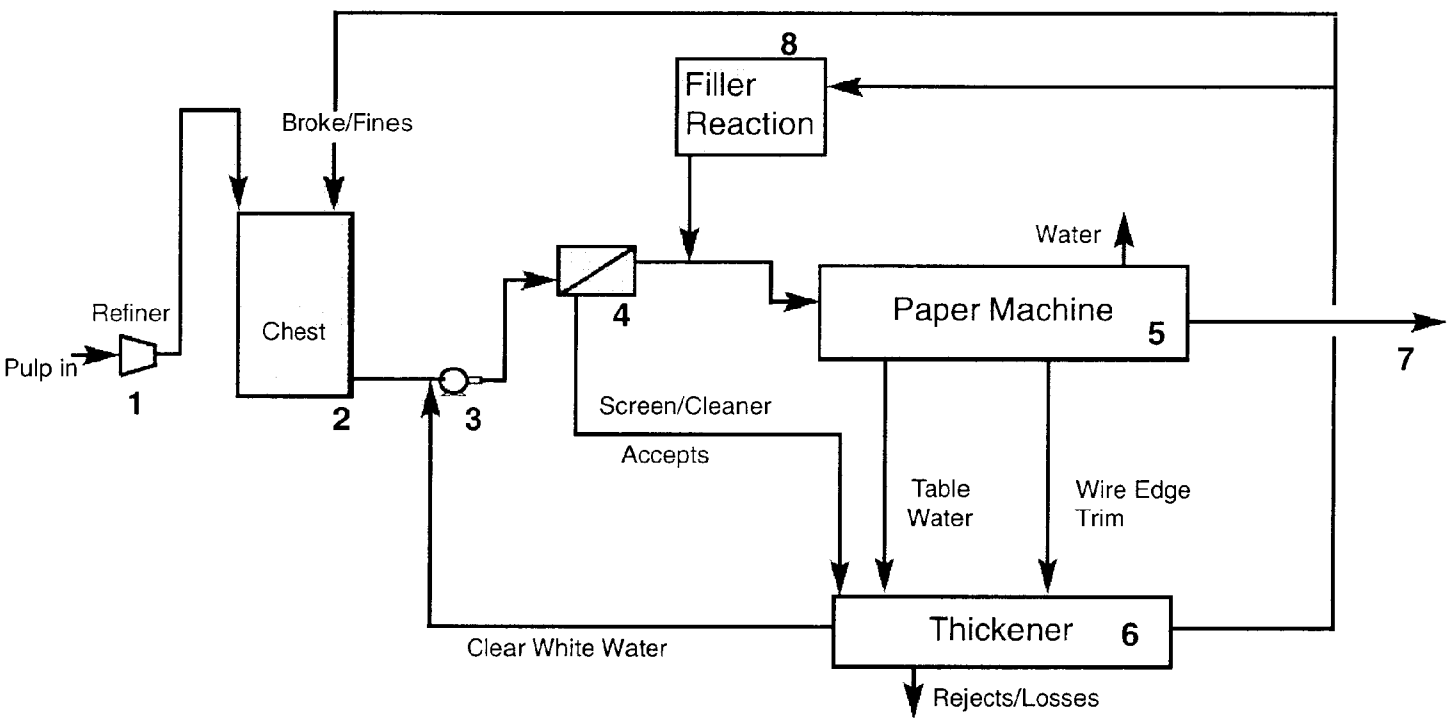
FIG. 1 illustrates a method for manufacturing paper using fiber-filler complexes according to the process of the invention.

As illustrated in FIG. 1, the method of the invention involves utilizing process streams from the paper making process. The process streams may be separated after the screening step 4, or at various points along the paper machine 5. The process streams are passed on to a thickener 6 to form a residue.

The process stream separated contains fiber fines and may also contain filler material and retention chemicals. The process stream is combined with the pulp fibers to expand the fiber surface area, and thickened to form a residue. This material is treated to deposit precipitated calcium carbonate (PCC) in situ on the fibers 8. The PCC treatment is done on the thickened white water solids after combination with virgin fibers. The expanded surface area of the fiber fines results in high loading of PCC.

Figure 2:
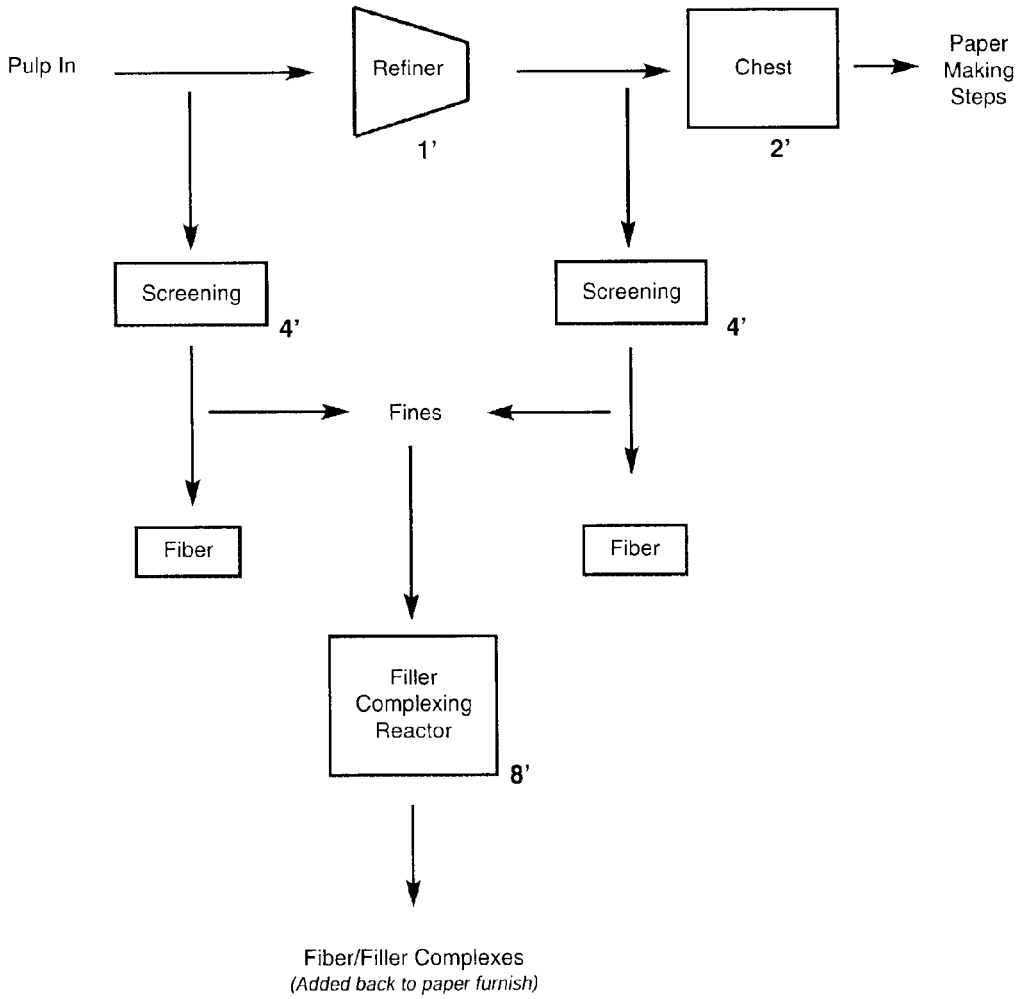
FIG. 2 illustrates a method for manufacturing paper using fiber-filler complexes according to another embodiment of the process of the invention.

In another embodiment as illustrated in FIG. 2 a method of obtaining a fiber fines stream is either prior to the refining 1' (primary fines) or after refining (secondary fines) is provided. Process streams, including fiber fines, which are obtained at other stations during the papermaking process are encompassed by the invention method. Generally, the process streams are separated by separation procedures, including screening and/or cleaners, although other separation methods may be used and are encompassed by the invention. In any event, once the process streams, including the fiber fines, are separated, they are subject to treatment to produce fiber-filler complexes which are used to produce filler loaded paper or paperboard products.

Preferably, the fiber-filler complexes are formed by the processes described in Cousin et al. and Matthew, by adding lime (CaO) and carbon dioxide gas into the reactor to form precipitated calcium carbonate (PCC). However, other particulate filler material, such as talc, clay, etc, may be added to the fiber fines and used in the papermaking process to form the paper.

Figures 3A, 3B:
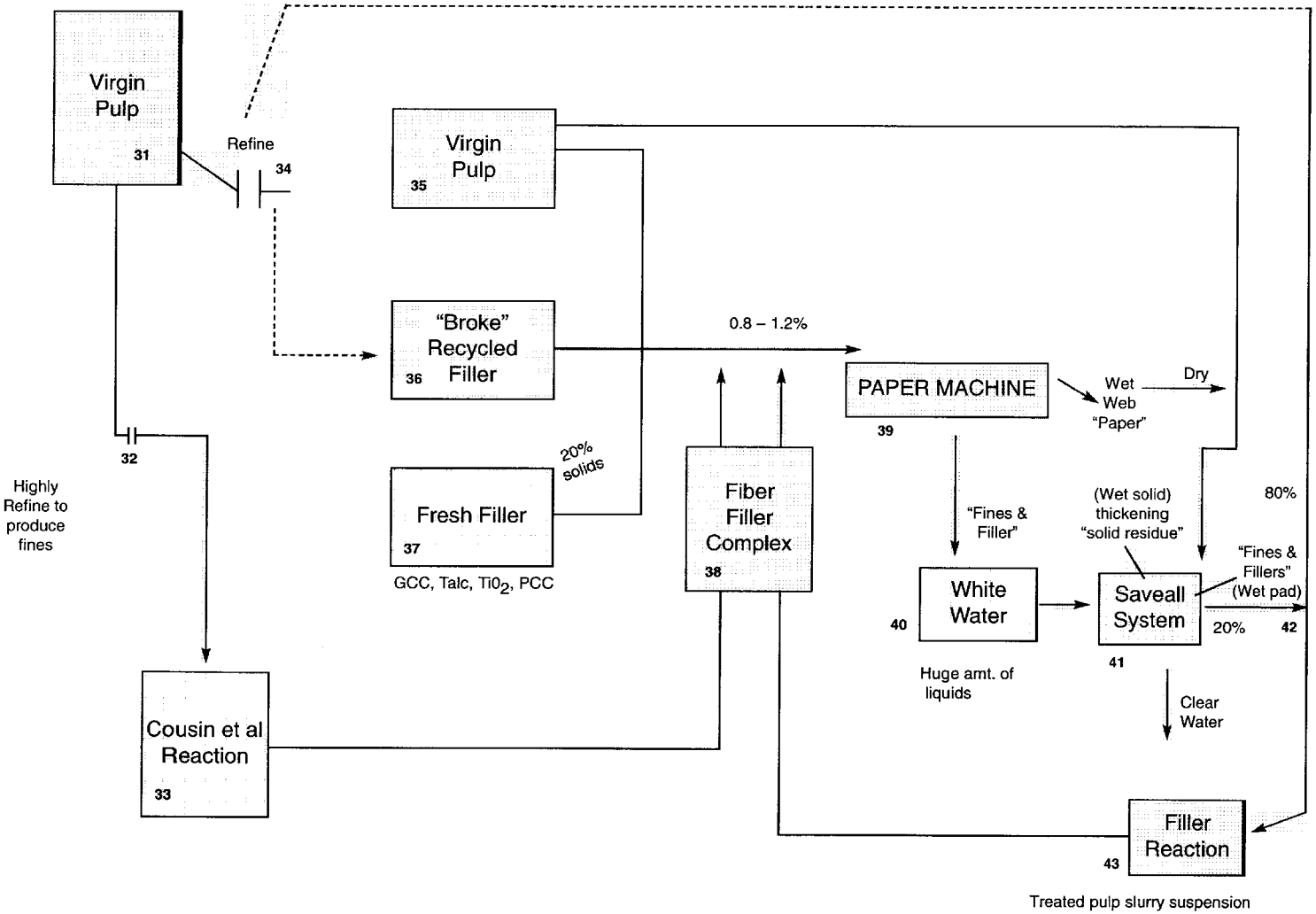
FIGURE 3A PRIOR ART
FIG. 3A illustrates the prior art processes as described in Cousin et al. where virgin pulp is refined to produce fines which are then subjected to treatment to cause precipitation of calcium carbonate in situ.
FIG. 3B illustrates the process of the invention wherein a process stream is combined with a source of natural long fibers (virgin pulp); thickened; and sent to a reactor for treatment to form fiber-filler complexes; and using the fiber-filler complexes to form the paper.

FIG. 3A illustrates the prior art process as described in the Cousin et al. patents where virgin pulp is refined to produce fines which are then subjected to treatment to cause precipitation of calcium carbonate in situ. The fiber-filler complexes formed are cycled to the papermaking machine to produce a loaded paper.

As illustrated in FIG. 3B, the invention provides enhancement of the fiber surface area of the pulp "starting" material, without the need to refine the virgin pulp fibers, by concentrating process streams, including fines and/or filler, from the papermaking process and combining the thickened residue with virgin pulp fibers. The white water process stream 40, which is a by product of the paper machine and includes "fines and filler", is combined with the long fibers 41, thickened 42 and sent to a reactor 43 for treatment to form a fiber-filler complex slurry. The treated pulp slurry is cycled to the papermaking process to produce a loaded paper.

Figure 4:
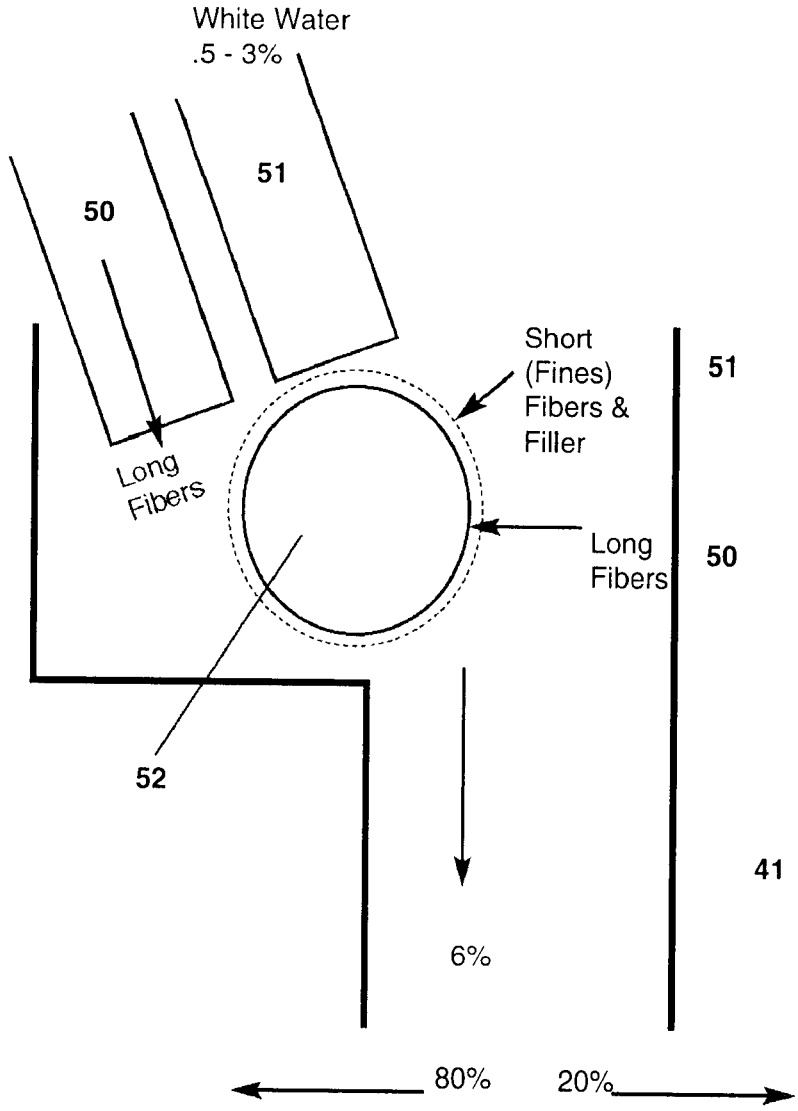
FIG. 4 is a more detailed illustration of the process of the invention showing the combining of the process stream including fines and/or filler with long fibers.

FIG. 4 is a more detailed illustration of the process of the invention showing combination of the process stream containing the fiber fines and/or filler 51, with long fibers (virgin pulp) 50. The mixture is then thickened—forming a wet "solid" pad (pulp slurry suspension of 6% solids).

Approximately 20% is sent to the filler reactor for treatment and the treated pulp slurry is used in the papermaking process to produce a loaded paper. The combined mixture of long fibers, fines and filler is essentially the "starting" material for the processes described in the Cousin et al. patents which deposit precipitated calcium carbonate (PCC) in situ on the fibers. The starting fiber material and source of fiber fines can be from virgin, recycled, bleached or unbleached, natural or synthetic pulp. The fiber fines utilized in the invention process can be primary or secondary fines. Typically, primary fines are natural with the pulp and are separated prior to the refining step. Secondary fibers are generally referred to those fines that are made—a source of secondary fiber fines is in the refining step and other processing steps. Nominally refined pulp (hardwood, softwood or a blend of papermaking fibers) can be processed through a size classification device, such as a pressure screen. The source of fines could also be from wet or dry broke, recycled through the paper machine, or from recycled paper (pre- or post consumer waste paper).

Figure 5:
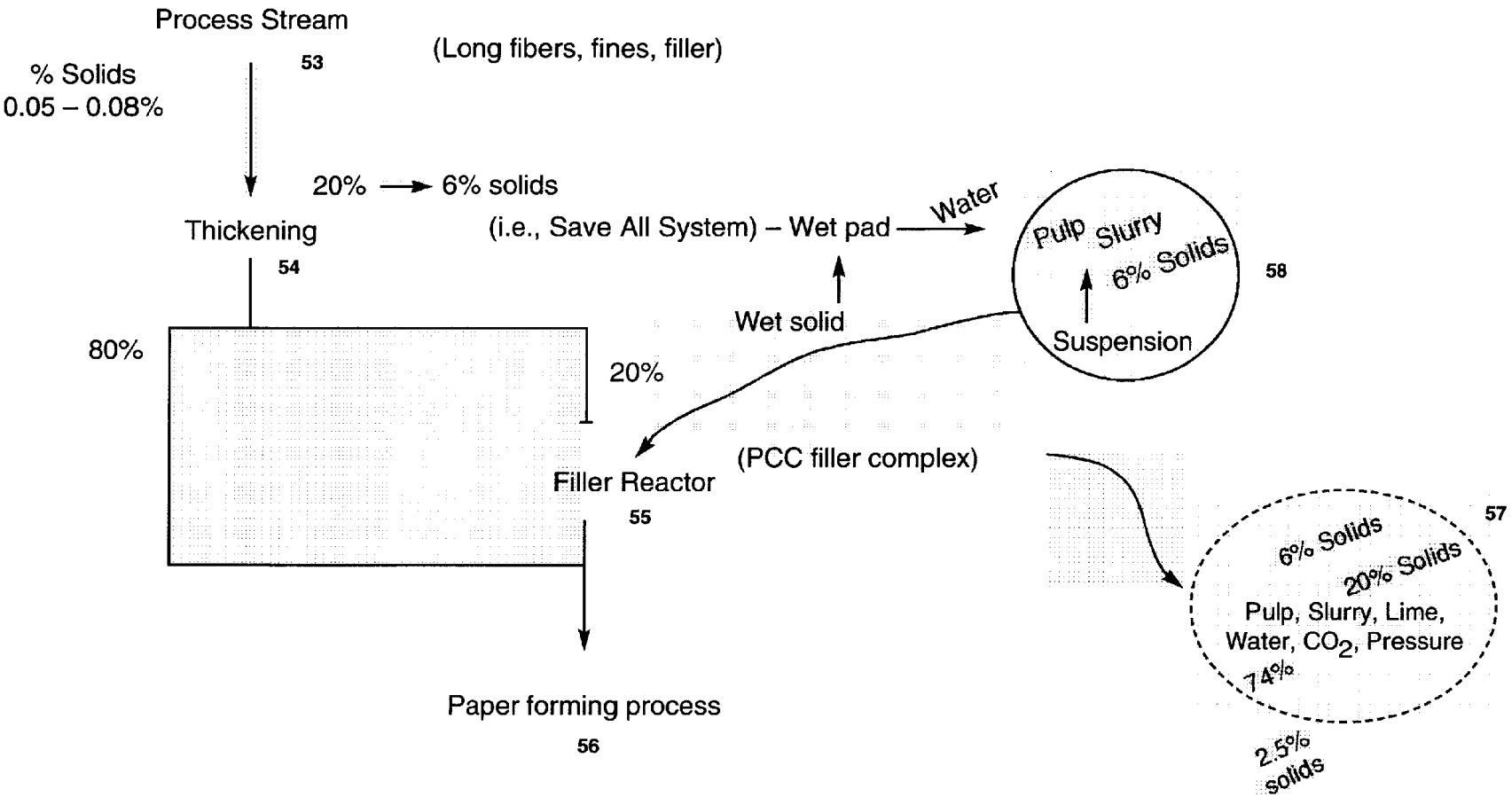
FIG. 5 is a schematic illustration of the process of the invention.
Figure 6:
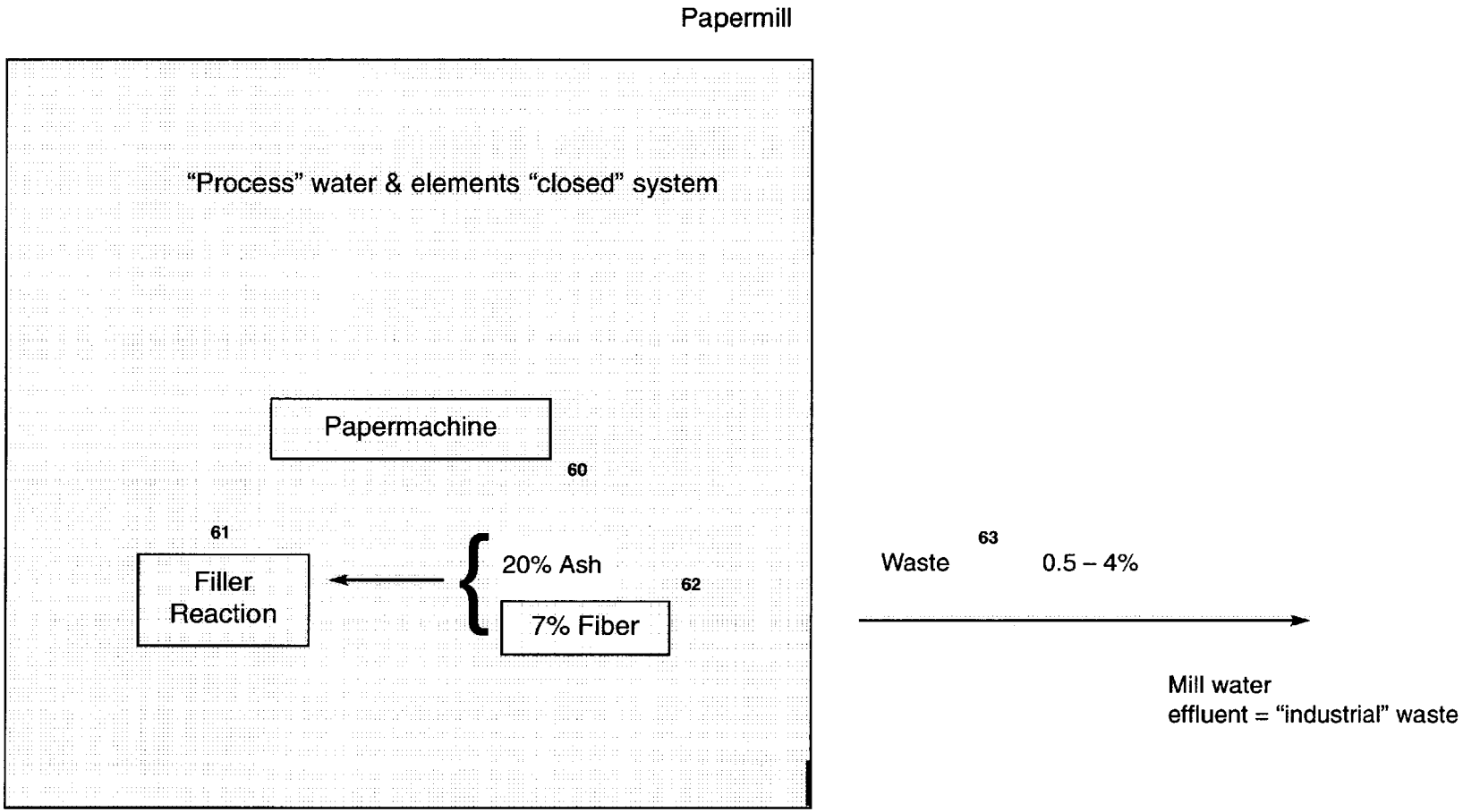
FIG. 6 illustrates the process of the invention as a "closed" system that utilizes "process" water and elements within the papermill as opposed to the prior art use of "industrial" waste which is mill water effluent.

The remaining 80% is recycled back to the papermaking process (see FIGS. 4 and 5). As illustrated in FIG. 6, the invention process is a "closed" system that utilizes "process" water and elements within the papermill which minimizes waste, as opposed to utilizing the mill water effluent which is considered industrial waste.

Figure 7:
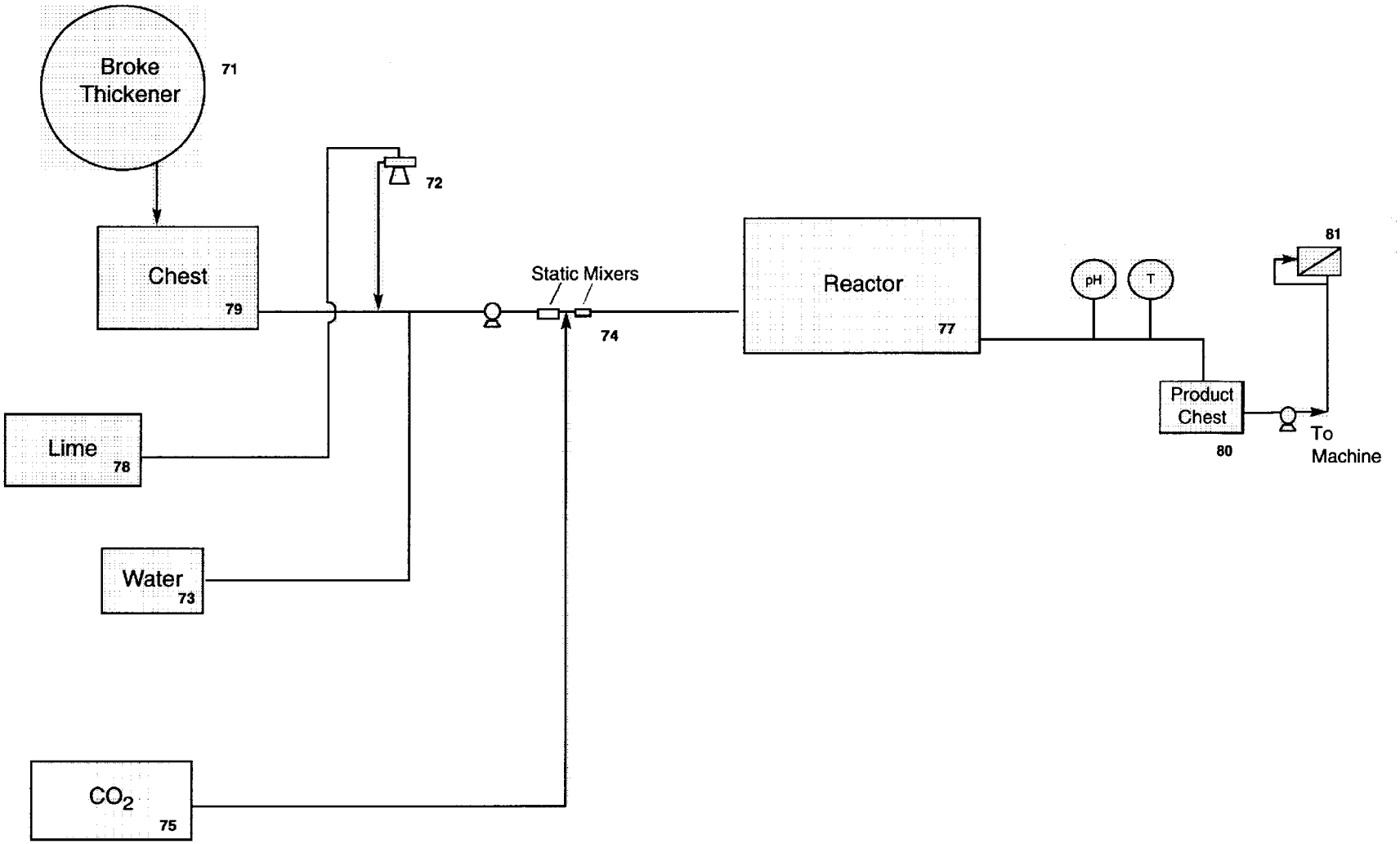
FIG. 7 illustrates a method for manufacturing paper using fiber-filler complexes according to another embodiment of the process of the invention.

A preferred process embodiment according to the invention method is illustrated in FIG. 7. The starting material used was pulp (thickened residue) containing both fines and hardwood fiber. The fines include papermaking fines and other ingredients (including filler/mineral particles) that did not get entrapped on the paper web and made its way through the wire of the paper machine. Dilution water and lime were added sequentially into this line, with the ratio of lime to pulp varied to target desired calcium carbonate loadings. The pulp was mixed with (filtered) slaked lime 72 and mill water (fresh cool water) 73 to a consistency of 1.0 to 3.5%. Mixing is conducted in-line.

The slurry of pulp, dilution water and lime pass a static mixer 74 where the ingredients are blended. Gaseous carbon dioxide 75 is injected into the line. The slurry entered another static mixer 74 where all the ingredients are blended again. The slurry passes the reactor 77 at temperatures between 60 to 140° F. The pH of the outlet stream was monitored and controlled in the range of 6.5 to 7 by adjusting the carbon dioxide flow to the reactor. The fiber-filler complex exiting the reactor is stored in a tank and then sent to the paper machine after further dilution to 0.5 to 0.8% consistency.

The paper making process generates both primary and secondary fines. The invention provides a process to segregate these fines upstream from the paper-making process/papermachine. Generally, the size of the fines separated are in the range of 0 to 100$\mu$. A classifier is used to separate the fines which are collected and then treated in the "fiber-filler complexing" reactor. The complexes are then returned to the furnish and fed to the papermachine headbox or other points in the paper making process to produce the paper.

In another embodiment, a series of screens are used (to classify the fiber) and refiners are used to refine only the long fiber fraction. Each screen provide a fines-rich stream that would feed into a reactor to form the fiber/filler complexes. A screen placed before the first refiner would separate out the fines from the pulping and bleaching process (primary fines), while screens placed between the refiners or after the last refiner would separate the secondary fines generated in the refining process.

In addition, a pump could be used to adjust the consistency similar to the POM pump, and screen and refine pulp directly from the last washer or the high density chest, which is at higher consistency than the thick stock. This embodiment would streamline the process by bypassing the high or low density chests.

The fiber/filler complexes are preferably formed according to the process conditions and parameters as are described in the Cousin et al and Matthew et al. patents, although other methods of producing such complexes are encompassed by the invention process. The lime and fines slurry can have a consistency as high as 10% but preferably below 5%. The Cousin et al. process describes a batch reaction process and Matthew et al. describes the continuous approach for forming the complexes. Process temperatures can vary between 33 to 200° F. The pressure in the reactor can vary between 14.6 psia and several atmospheres above ambient. The carbon dioxide gas to lime molar ratios can vary between 0.1 to 10, preferably around 1 to 1.5. The reactor/reaction parameters can be controlled and varied to yield complete reaction and optimal crystal growth and morphology. The carbon dioxide gas used in the reaction could be pure or from a source such as flue gas. Also as described in Matthew et al. preacidifying the fines stream prior to lime addition and other step-wise introduction of lime and carbon dioxide gas can be used in the invention process.

The starting fiber material and source of fiber fines can be from virgin, recycled, bleached or unbleached, natural or synthetic pulp. The fiber fines utilized in the invention process can be primary or secondary fines. Typically, primary fines are natural with the pulp and are separated prior to the refining step. Secondary fibers are generally referred to those fines that are made—a source of secondary fiber fines is in the refining step and other processing steps. Nominally refined pulp (hardwood, softwood or a blend of papermaking fibers) can be processed through a size classification device, such as a pressure screen. The source of fines could also be from wet or dry broke, recycled through the paper machine.

As discussed in the background section, fines recovered from the paper machine white water and other "waste" streams are known in the art. However, typically, the waste fiber fines vary between 0.5 to 4% of the mill's total fiber production. If filler loading is done at the typical level of 1:3 (fiber:filler), the maximum resulting filler level in the sheet is only 12%. Thus, by using white water fines and waste streams alone it may not be possible to displace all the current "conventional" PCC (up to 23%) with filler-fiber complexes. The invention process provides target filler levels in the paper at levels that are at least 5% and preferably higher than 20%.

The following examples illustrate various aspects of the invention but are not to be interpreted as limiting it. These examples are merely representative and are not inclusive of all of the possible embodiments of the invention.

EXAMPLE 1

Pulp Screening/Fractionation Trial

A pulp stream typically contains long and short fibers. Pressure screens can separate the pulp (feed) into long (reject) and short (accept) fiber streams. Pulp fines exist in any fiber stream. Some are just short fiber/fibrils present in the stock. Most others are generated as fiber furnishes pass through cooking and bleaching processes. In the paper machine area, the refining step generates a significant amount of fines, therefore the pulp can be screened either before or after the refiner. In this example, the pulp was screened upstream from the refiner. Optimum process conditions, such as pulp consistency, feed rate, reject/accept split ratios, etc., as well as the hardware, i.e. screen, rotor-configuration, orfice/slot sizes, etc. were determined.

Screening refined pulp is preferably used in the invention process for producing the filler-fiber complexes, however, unrefined pulp can be used as well.

Procedure

Bleached, unrefined southern softwood was used. Several combinations of screening baskets, rotors and screen parameter configurations were used and feed, accept (fines) and reject (long fibers) cuts were collected. These were analyzed for fiber length. The raw data was used to calculate the Arithmetic-weighted length, length-weighted length, weight-weighted length, length-weighted fines % and arithmetic-weighted fines % (all of these are standard reporting units for fiber length).

Results

In the following tables, the results of the fiber length analyses are summarized using three different screening devices. A difference (increase) in the length values between the feed and long (reject) fiber cuts indicates that the screen was effective in separating fines from the feed. Screening Device #1 was a dewatering press; Screening Device #2 were baskets with 0.05" smooth holes; and Screening Device #3 were baskets with 0.018" slotted holes.

TABLE 1

SCREENING DEVICE #1

| PARAMETER | FEED | REJECT (LONG) |
|---|---|---|
| ARITH.-WT., length, mm | 0.43 | 1.06 |
| LGTH-WT., length, mm | 1.82 | 2.34 |
| WT.-WT., length, mm | 2.77 | 3.07 |
| LGTH-WT., fines % | 12.87 | 2.74 |
| ARITH-WT., fines % | 69 | 33.51 |

TABLE 2

| SCREENING DEVICE #2 | | |
|---|---|---|
| PARAMETER CONSISTENCY = 2.5% | FEED | REJECT (LONG) |
| ARITH.-WT., length, mm | 0.53 | 0.81 |
| LGTH-WT., length, mm | 2.1 | 2.39 |
| WT.-WT., length, mm | 3.04 | 3.21 |
| LGTH-WT., fines % | 10.03 | 5.42 |
| ARITH-WT., fines % | 65.69 | 51.98 |

TABLE 3

| SCREENING DEVICE #3 | | |
|---|---|---|
| PARAMETER | FEED | REJECT (LONG) |
| ARITH.-WT., length, mm | 0.63 | 0.84 |
| LGTH-WT., length, mm | 2.17 | 2.4 |
| WT.-WT., length, mm | 3.03 | 3.18 |
| LGTH-WT., fines % | 7.78 | 5.02 |
| ARITH-WT., fines % | 60.25 | 50.68 |

EXAMPLE 2

Hand sheets were made using the following filler materials:

1. Control: commercially available ground calcium carbonate (GCC);
2. Comparison: Fiber-filler complexes made according to the Cousin et al and Matthew patents. The starting pulp used was highly fibrillated pulp, refined down to ~50 Canadian standard freeness (4C); and
3. Fiber-filler complexes made according to the invention process (C*).

Table 4 below summarizes a comparison of the physical characteristics of the sheets formed using each of the filler materials above.

TABLE 4

| Parameter | GCC | 4C | C* at 76% loading | C* at 66% loading |
|---|---|---|---|---|
| Brightness, ISO | 90.5 | 89.7 | 92.4 | 91.7 |
| Opacity, % | 88.5 | 89 | 89.3 | 90.5 |
| Bendtsen Porosity, ml/min | 1,450 | 850 | 1,070 | 1,040 |
| Tensile, km | 2.6 | 3.1 | 2.9 | 3.1 |
| Scott Bond, J/m2 | 60 | 128 | 106 | 107 |
| Tear, mN · m2/g | 850 | 770 | 800 | 800 |
| Burst, KPa · m2/g | 1.1 | 1.8 | 1.7 | 1.7 |
| Ash Retention, % | 67 | 79.7 | 79.7 | 78.5 |

Figure 8:
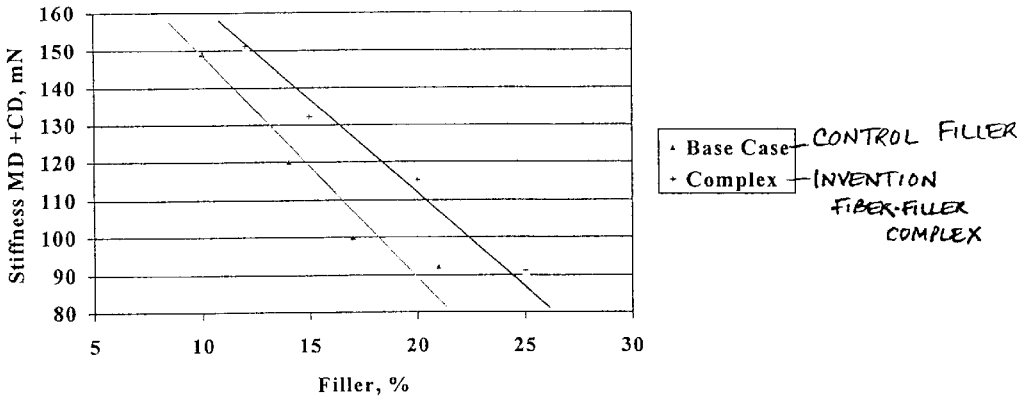
FIG. 8 is a graphic illustration of the stiffness characteristics of the paper made according to the process of the invention using fiber-filler complexes, compared with a base paper made with conventional filler.
Figure 1:
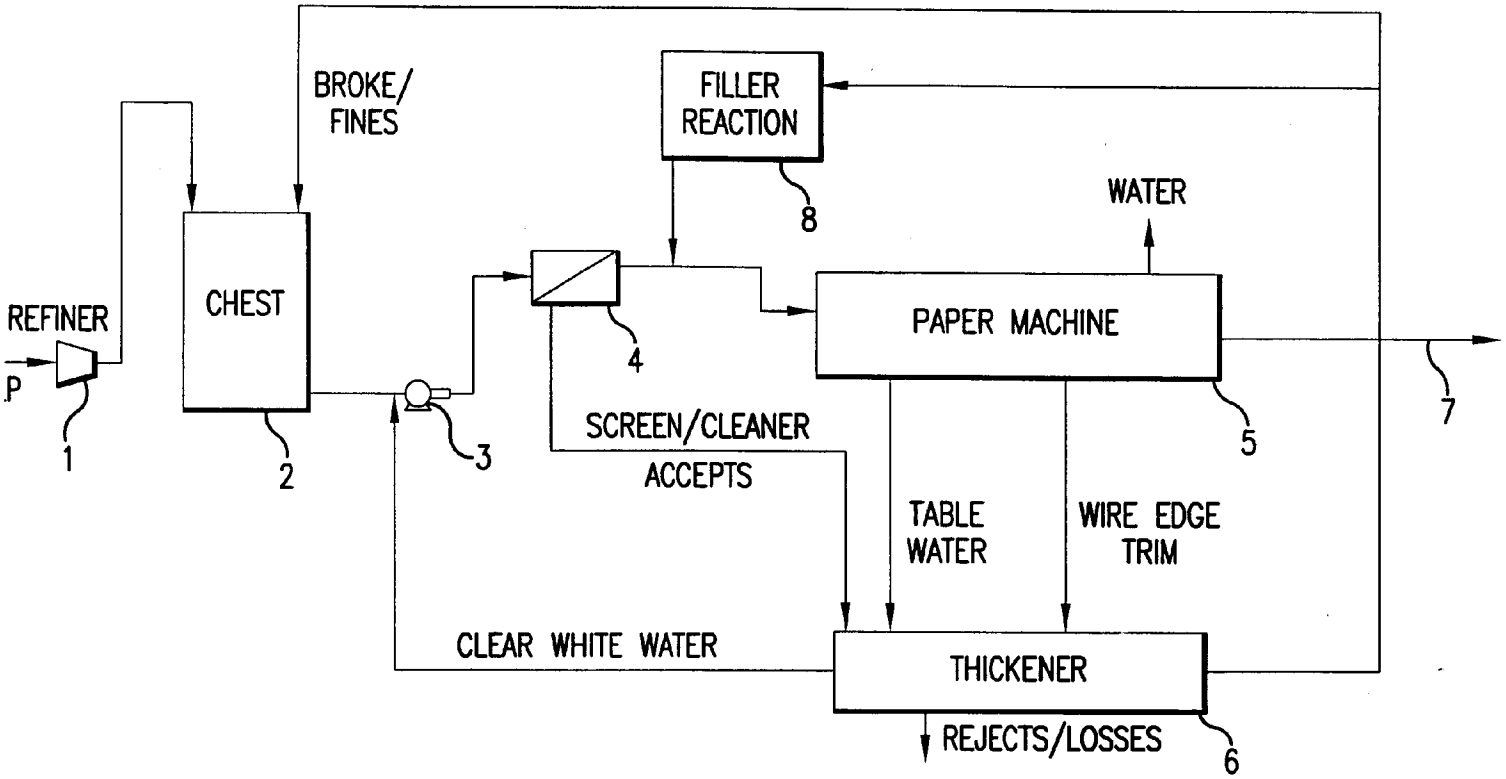
Figure 2:
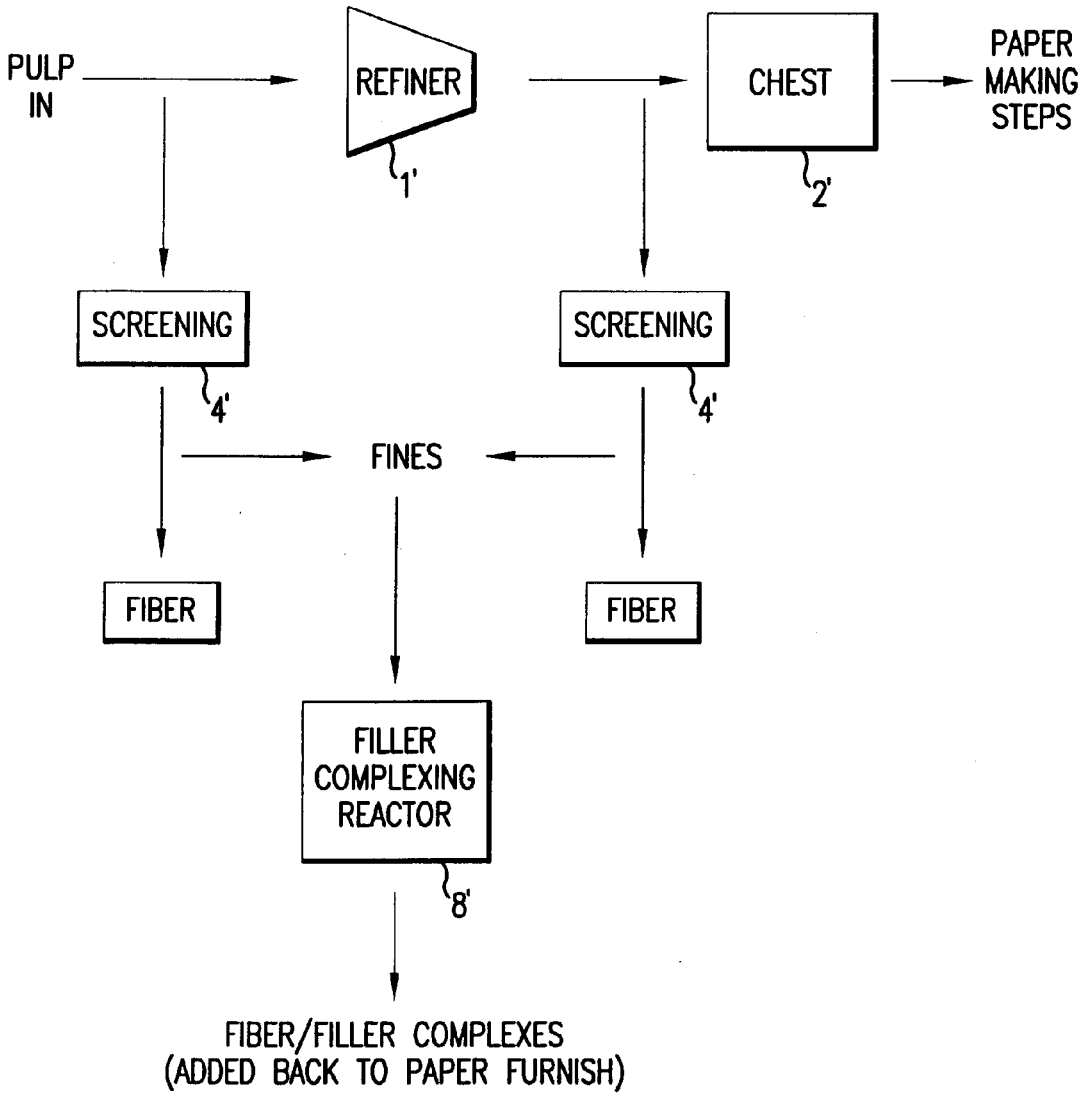
Figures 3A, 3B:
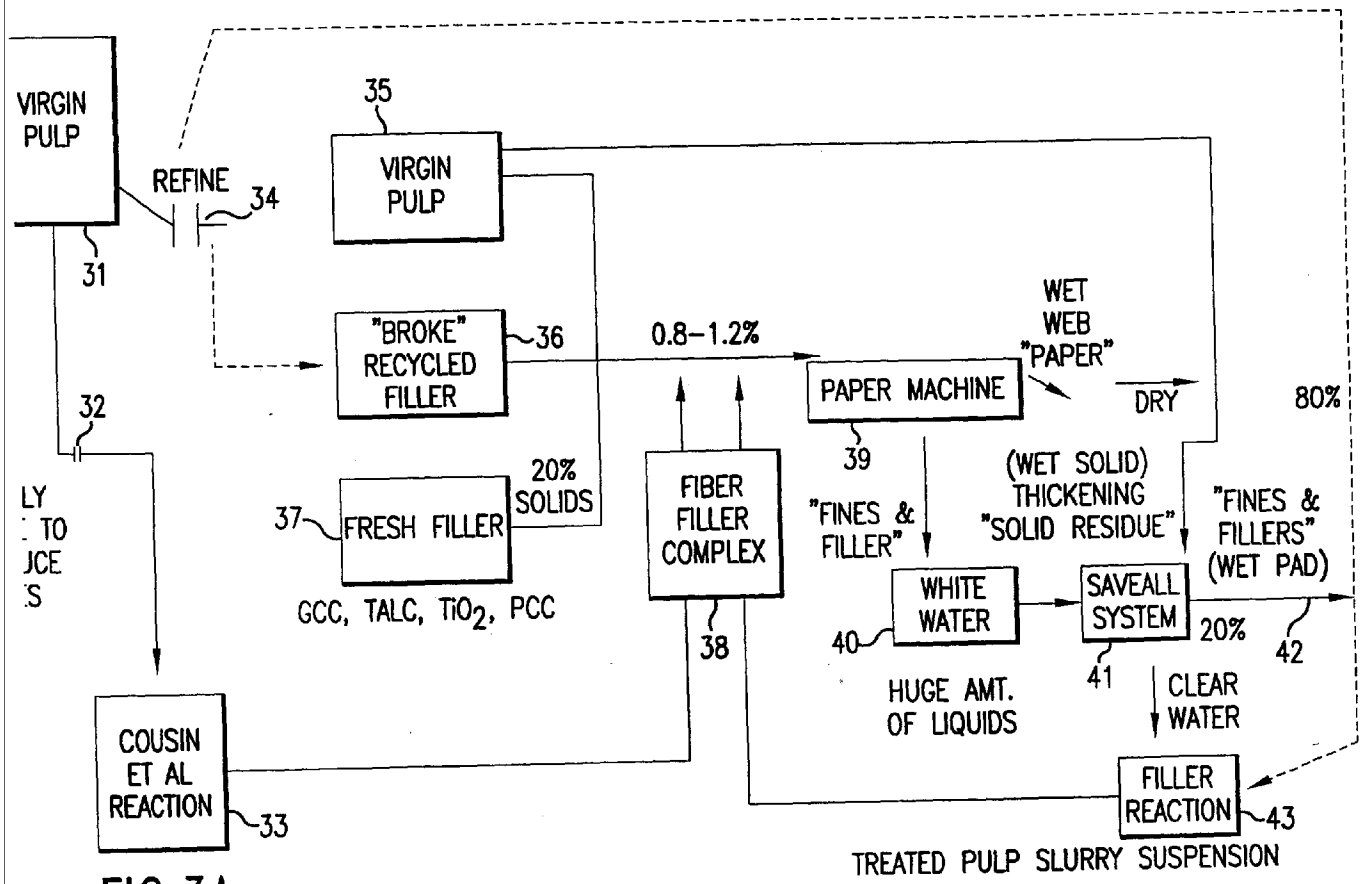
FIG.3A PRIOR ART
Figure 4:
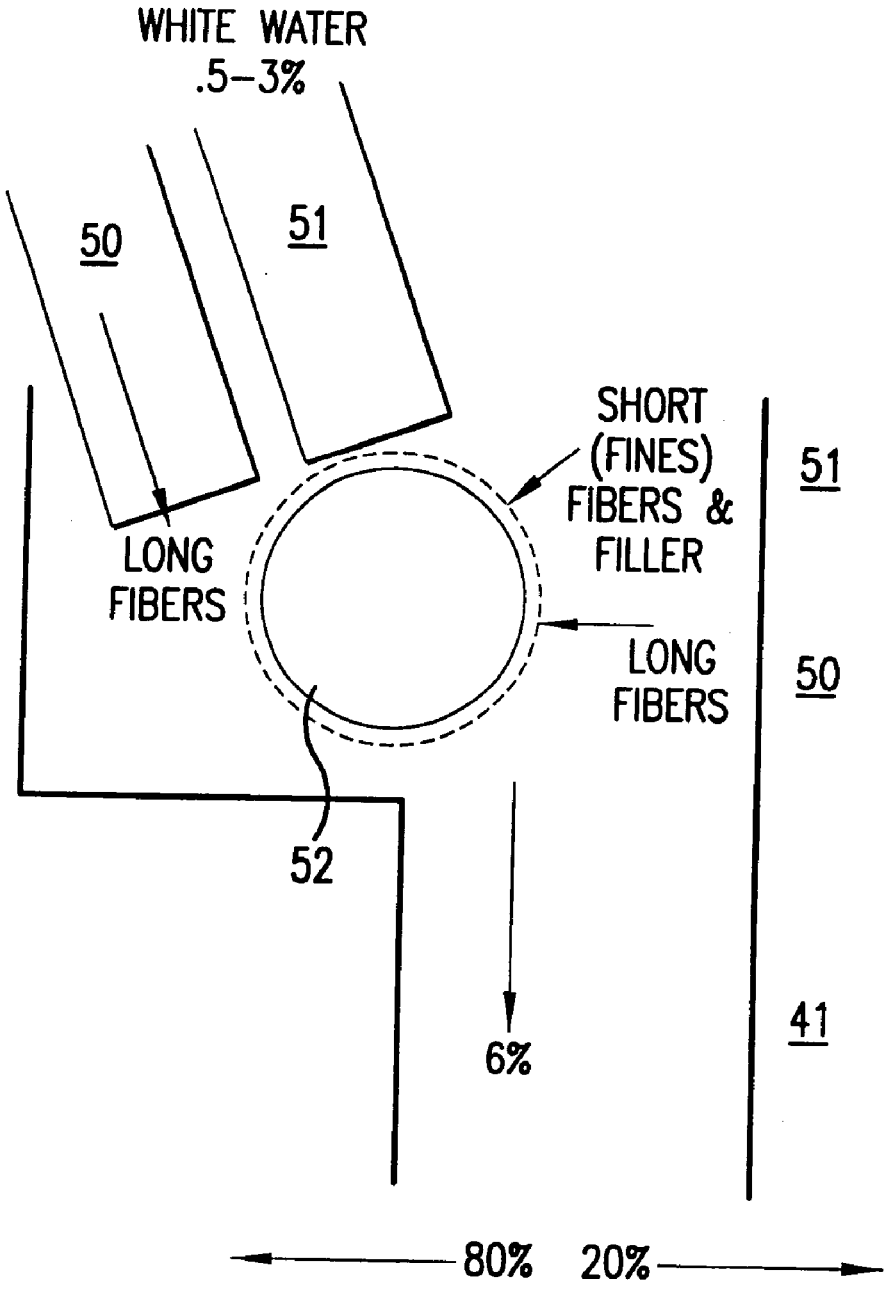
Figure 5:
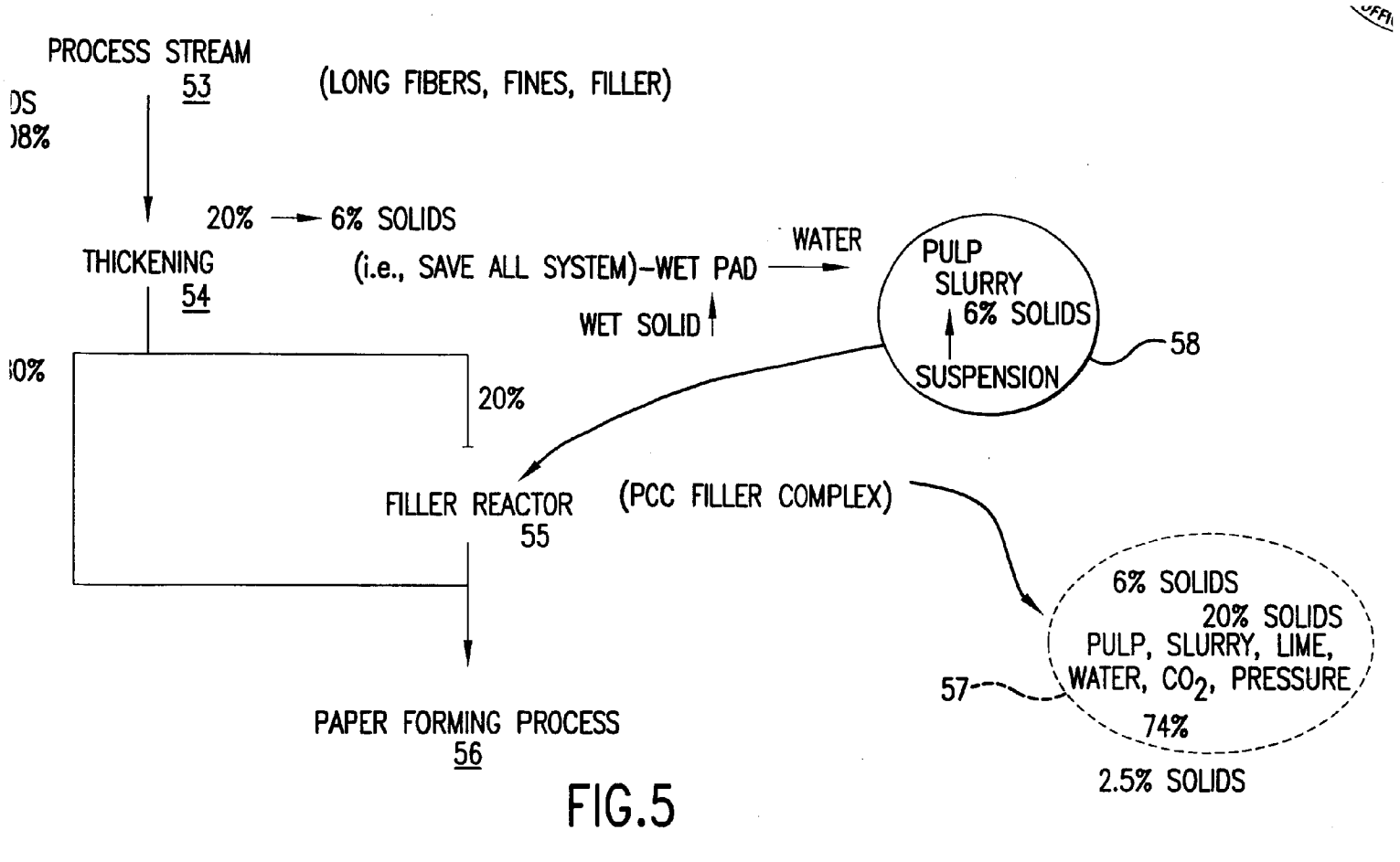
Figure 6:
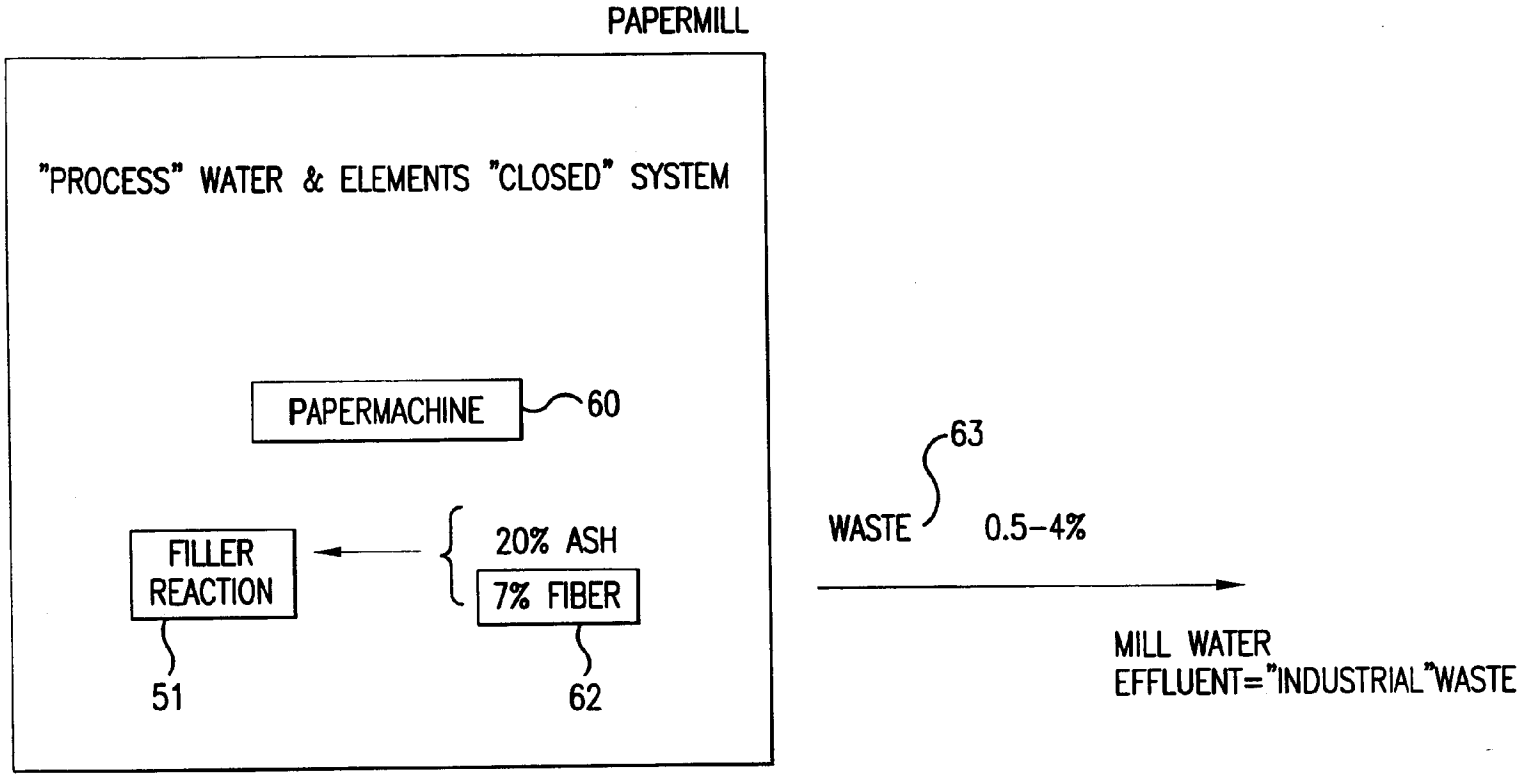
Figure 7:
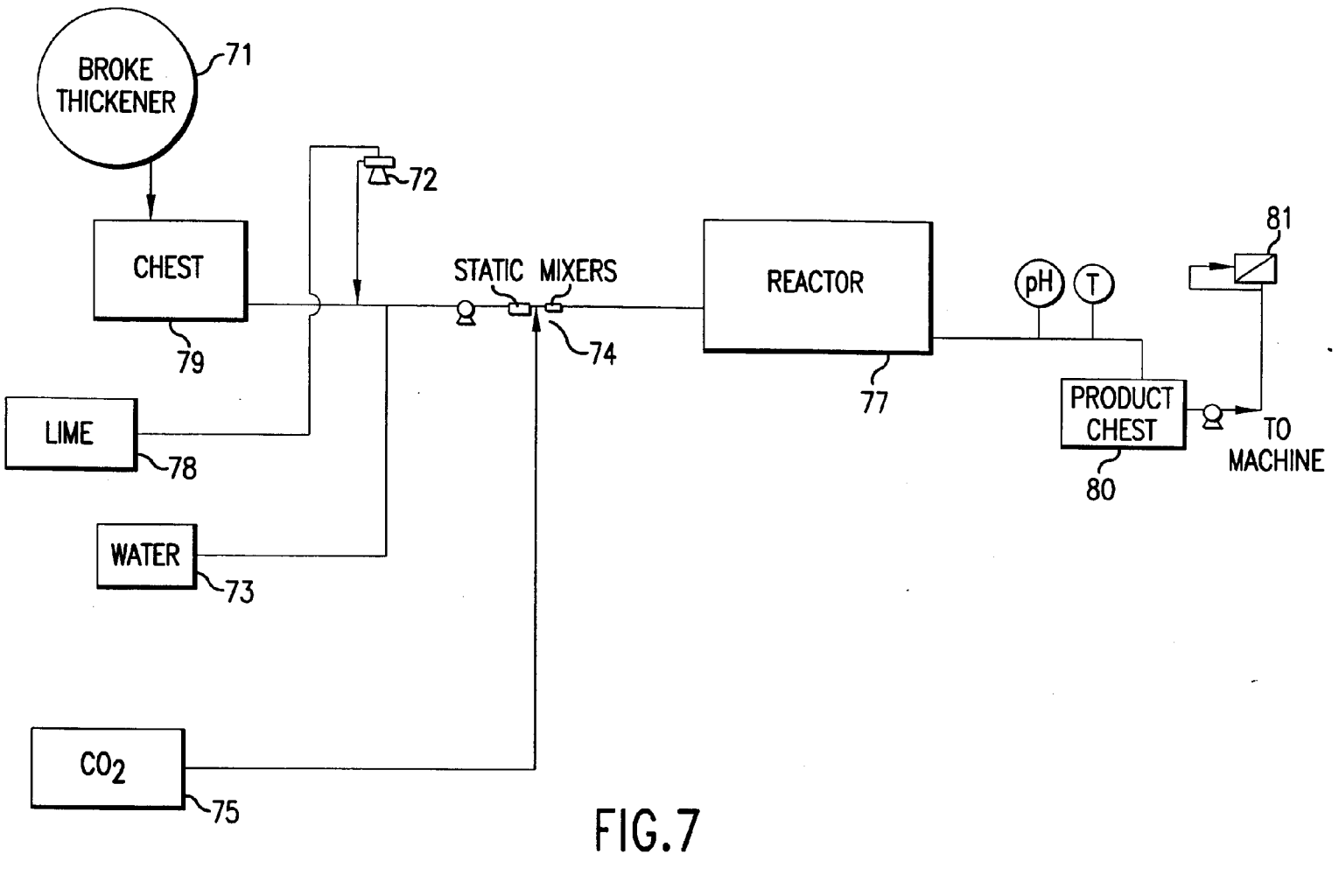
Figure 8:
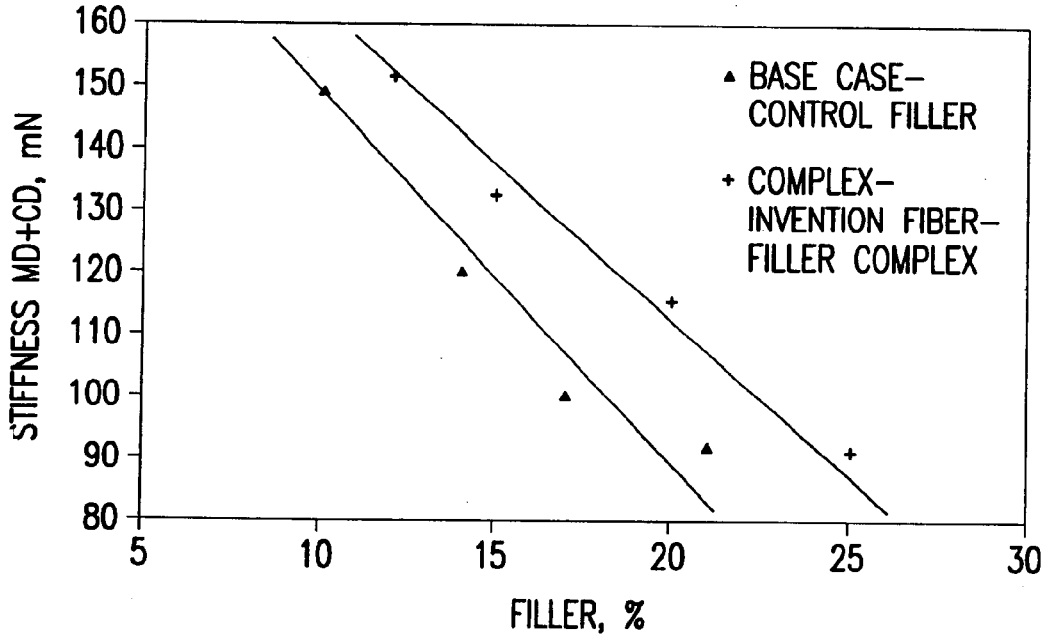

A comparison of stiffness characteristics of paper using the control (GCC) filler and the invention fiber-filler complexes are graphically depicted in FIG. 8. It is shown that the invention process provides a 4–5% filler increase for the same product stiffness. The invention process yields better physical properties at lower capital and operating costs.

EXAMPLE 3

The three filler materials from Example 2 were used to produce paper on a paper making machine. A comparison of the optical properties, stiffness, filler retention and operating costs are listed in Table 5.

TABLE 5

| | PCC/GCC | 4C | C* |
|---|---|---|---|
| Physical/Optical Properties | 0 | + | 0 |
| Stiffness | 0 | + | ++ |
| Retention | 0 | ++ | ++ |
| Capital and Operating Costs | 0 | ++ | 0 |

+ means increase

It was seen that using the invention process, the first pass ash retention on the machine improved from 76 to 82%; retention aid usage was decreased by up to 50%; the cross directional ash profile improved from +/−1.0 to +/−0.3; and the sheet became less two-sided. Scanning electromicrographs of the wire- and felt-side surfaces showed more uniform filler coverage with the fiber-filler complex of the invention than with conventional precipitated calcium carbonate (PCC).

Finally, variations from the examples given herein are possible in view of the above disclosure. The foregoing description of various and preferred embodiments of the present invention has been provided for purposes of illustration only, and it is understood that numerous modifications, variations and alterations may be made without departing from the scope and spirit of the invention as set forth in the following claims.

What is claimed is:

1. A method for manufacture of loaded paper or paperboard products, comprising the steps of:

separating at least one process stream from the papermaking process; wherein said process stream includes fines;

combining said process stream with long fibers and thickening to form a residue;

treating said residue to form fiber-filler complexes; and using said fiber-filler complexes in the papermaking process to form the paper.

2. The method according to claim 1, wherein said process stream further includes filler.

3. The method according to claim 1, wherein said long fibers have a length greater than 0.1 mm.

4. The method according to claim 1, wherein said long fibers are natural or synthetic.

5. The method according to claim 1, wherein said long fibers are refined.

6. The method according to claim 1, wherein said process stream is from the paper machine.

7. The method according to claim 1, wherein said process stream is obtained prior to the paper machine.

8. The method according to claim 1, wherein said process stream contains primary and/or secondary fines.

9. The method according to claim 1 wherein said residue is treated with calcium and carbonate ions to effect crystallization of calcium carbonate.

10. The method according to claim 9, wherein the crystallization of calcium carbonate is in situ.

11. The method according to claim 10, wherein said crystals of calcium carbonate bonds to the fines present in the residue.

12. The method according to claim 10, wherein said crystals of calcium carbonate bonds to the long fibers present in the residue.

13. The method according to claim 10, wherein said crystals of calcium carbonate mechanically bond to the filler present in the residue.

14. The method according to claim 10, wherein said crystals of calcium carbonate, $CaCO_3$ (PCC), are organized essentially in clusters of granules directly grafted onto the fines, filler and/or fiber present in the residue, without binders or retention aids present at the interface between said crystals of PCC and the fines, filler and/or fiber, so that the majority of said crystals of PCC trap said fines, filler and/or fiber by reliable and non-labile bonding to form the fiber-filler complex.

15. The method according to claim 1, wherein said residue is treated with particulate filler material to form the fiber-filler complexes.

16. The method according to claim 15, wherein said particulate filler material is selected from the group consisting of inorganic pigments, organic pigments, organic latices and hollow spheres.

17. The method according to claim 16, wherein said pigments are selected from the group consisting of talc, clay, $TiO_2$, calcium carbonate, silica based pigments and aluminum based pigments.

18. The method according to claim 1, wherein the paper has enhanced stiffness properties.

19. The method according to claim 1, wherein the paper has enhanced filler retention.

20. The method according to claim 1, wherein the paper has uniform z- and cross direction filler profiles.

21. A method for loading of filler material for manufacture of paper or paperboard products, comprising the steps of:

separating at least one process stream from the papermaking process; wherein said process stream includes fines;

combining said process stream with long fibers and thickening to form a residue;

treating said residue with calcium and carbonate ions to effect crystallization of calcium carbonate in situ to form fiber-filler complexes; and using said fiber-filler complexes in the papermaking process to form the paper.

22. The method according to claim 21, wherein said crystals of calcium carbonate, $CaCO_3$ (PCC), are organized essentially in clusters of granules directly grafted onto the fines, filler and/or fiber present in the residue, without binders or retention aids present at the interface between said crystals of PCC and the fines, filler and/or fiber, so that the majority of said crystals of PCC trap said fines, filler and/or fiber by reliable and non-liable bonding to form the fiber-filler complex.

* * * * *

UNITED STATES PATENT AND TRADEMARK OFFICE

CERTIFICATE OF CORRECTION

PATENT NO. : 6,592,712 B2
DATED : July 15, 2003
INVENTOR(S) : Koukoulas et al.

It is certified that error appears in the above-identified patent and that said Letters Patent is hereby corrected as shown below:

The Title page showing an illustrative figure, should be deleted and substitute therefor the attached title page.

Drawings,
Delete Drawing sheets 1-8 and substitute therefor the drawing sheets consisting of Figs. 1-8, as shown on the attached pages.

Signed and Sealed this

Twenty-fourth Day of August, 2004

JON W. DUDAS
*Director of the United States Patent and Trademark Office*

(12) United States Patent
Koukoulas et al.

(10) Patent No.: US 6,592,712 B2
(45) Date of Patent: Jul. 15, 2003

(54) METHOD TO MANUFACTURE PAPER USING FIBER FILLER COMPLEXES

(75) Inventors: Alexander A. Koukoulas, Ridgewood, NJ (US); Thomas E. Altman, Middletown, NY (US); M. C. Matthew, Neshanic Station, NJ (US); Thomas E. Amidon, Jamesville, NY (US); Fernand Mora, Pont de Claix (FR)

(73) Assignee: International Paper Company, Stamford, CT (US)

( * ) Notice: Subject to any disclaimer, the term of this patent is extended or adjusted under 35 U.S.C. 154(b) by 0 days.

(21) Appl. No.: 09/891,016

(22) Filed: Jun. 25, 2001

(65) Prior Publication Data

US 2002/0096272 A1 Jul. 25, 2002

Related U.S. Application Data

(60) Provisional application No. 60/214,593, filed on Jun. 27, 2000.

(51) Int. Cl.[7] ..... D21H 17/70

(52) U.S. Cl. ..... 162/9; 162/100; 162/149; 162/181.1; 162/181.2; 162/182; 162/189; 162/190

(58) Field of Search ..... 162/9, 100, 181.1, 162/181.2, 182, 190, 189, 149

(56) References Cited

U.S. PATENT DOCUMENTS

| | | | | |
|---|---|---|---|---|
| 2,470,577 A | | 5/1949 | Roderick et al. | |
| 3,152,001 A | | 10/1964 | Podschus et al. | |
| 3,262,877 A | | 7/1966 | Le Compte, Jr. | |
| 3,639,206 A | | 2/1972 | Spruill | |
| 3,833,463 A | | 9/1974 | Croom | |
| 3,833,464 A | | 9/1974 | Rolfe | |
| 4,941,945 A | | 7/1990 | Pettersson | |
| 5,082,887 A | | 1/1992 | Brown et al. | |
| 5,223,090 A | * | 6/1993 | Klungness et al. | 162/183 |
| 5,262,006 A | | 11/1993 | Andersson et al. | |
| 5,275,699 A | | 1/1994 | Allan et al. | |
| 5,342,600 A | | 8/1994 | Bleakley et al. | |
| 5,558,782 A | | 9/1996 | Bleakley et al. | |
| 5,665,205 A | | 9/1997 | Srivatsa et al. | |

(List continued on next page.)

FOREIGN PATENT DOCUMENTS

| | | |
|---|---|---|
| EP | 0604095 A1 | 6/1994 |
| EP | 0658606 A1 | 6/1995 |
| EP | 0936185 A1 | 8/1999 |
| EP | 1052227 A2 | 11/2000 |
| GB | 2265916 A | 10/1993 |
| JP | 162098/1987 | 7/1987 |
| WO | WO 96/28517 | 9/1996 |
| WO | WO 99/03928 | 1/1999 |
| WO | WO 99/42657 | 8/1999 |
| WO | WO 00/39029 | 7/2000 |

OTHER PUBLICATIONS

Toivonen, Olavi "A New Waste Conversion and Recycling Process" 82nd Annual Meeting, Technical Setion, CPPA, pp. A101–107, 1996.

Martin, RSE and Dr. RD Crowling "The Re–Use of Mineral and Fines From Paper Mill Waste Streams", 1998, pp. 227–237.

*Primary Examiner*—Peter Chin
(74) *Attorney, Agent, or Firm*—Dara L. Onofrio, Esq.; Onofrio Law

(57) ABSTRACT

A method for manufacture of loaded paper or paperboard products, comprising the steps of separating at least one process stream from the papermaking process, wherein the process stream includes fines and/or filler; combining the process stream with long fibers and thickening to form a residue; treating the residue to form fiber-filler complexes; and using the fiber-filler complexes in the papermaking process to form the paper.

22 Claims, 8 Drawing Sheets

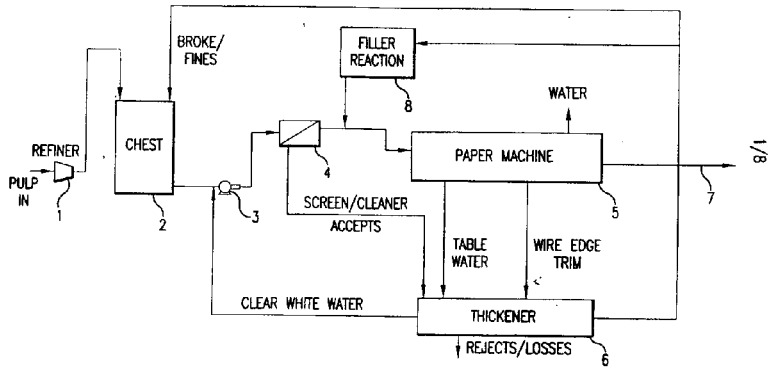

1/8